United States Patent [19]

Williams

[11] 4,422,704

[45] Dec. 27, 1983

[54] LATCH

[76] Inventor: Robert A. Williams, 2721 White Settlement, Fort Worth, Tex. 76107

[21] Appl. No.: 337,156

[22] Filed: Jan. 5, 1982

[51] Int. Cl.[3] ..... H01R 13/629

[52] U.S. Cl. ..... 339/91 R; 285/315; 285/318

[58] Field of Search ..... 339/75 R, 75 M, 91 R, 339/256 RT, 273 R; 285/304, 315, 318, 321, 323

[56] References Cited

U.S. PATENT DOCUMENTS

| | | | |
|---|---|---|---|
| 2,225,610 | 12/1940 | Christian | 285/321 |
| 2,226,826 | 12/1940 | Miller | 285/321 |
| 2,677,811 | 5/1954 | Anderson et al. | 339/91 R |
| 3,532,101 | 10/1970 | Snyder, Jr. | 285/318 |
| 4,072,386 | 2/1978 | Wallo | 339/91 R |

FOREIGN PATENT DOCUMENTS

| | | | |
|---|---|---|---|
| 1034886 | 8/1953 | France | 285/315 |

*Primary Examiner*—John McQuade

*Attorney, Agent, or Firm*—Wofford, Fails & Zobal

[57] ABSTRACT

A latching apparatus for securing two electrical connecting means together in a given relationship, one of said electrical connecting means being carried by a member having an outer annular groove at one end thereof. The latch comprises a housing body which carries the other of said electrical connecting means. The housing body has a forward end with space surrounded by an outer annular wall for receiving said one end of said member. An inner annular groove is formed in the inner portion of said wall at the forward end of said housing body. The outer portion of said wall at said forward end of said housing body has three angularly spaced apart axially extending grooves formed therein which intersect said inner annular groove forming three angularly spaced apart openings which expose said inner annular groove through said three angularly spaced apart axially extending grooves. An annular coiled spring is located in said inner annular groove. A sleeve is carried by said housing body for axial sliding movement between forward and rearward positions. Three angularly spaced apart arms extend from the forward end of said sleeve for sliding movement in said three angularly spaced apart axially extending grooves respectively. In the forward position of said sleeve, said arms force the portions of said annular coiled spring at said openings into said space at said forward end of said body and into said outer annular groove of said member for latching purposes.

7 Claims, 12 Drawing Figures

Fig. 7
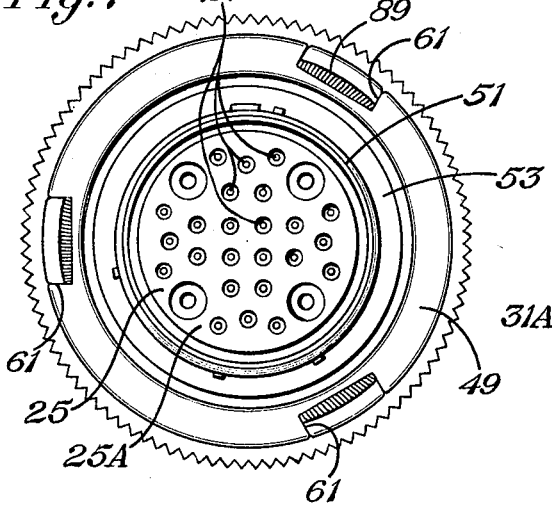
Fig. 9
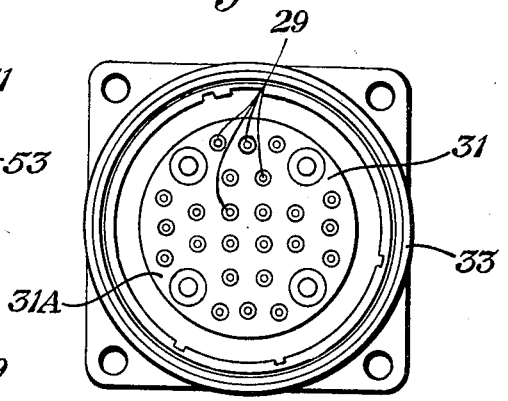
Fig. 8
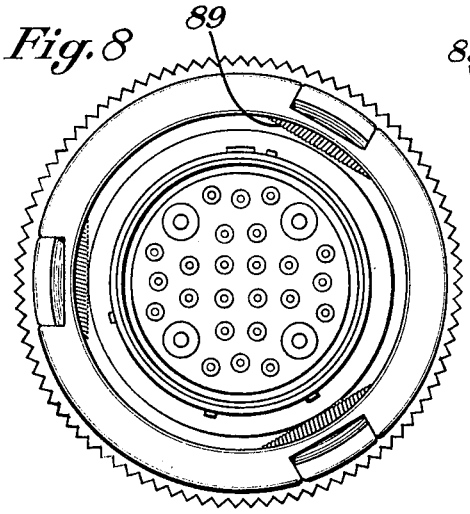
Fig. 5
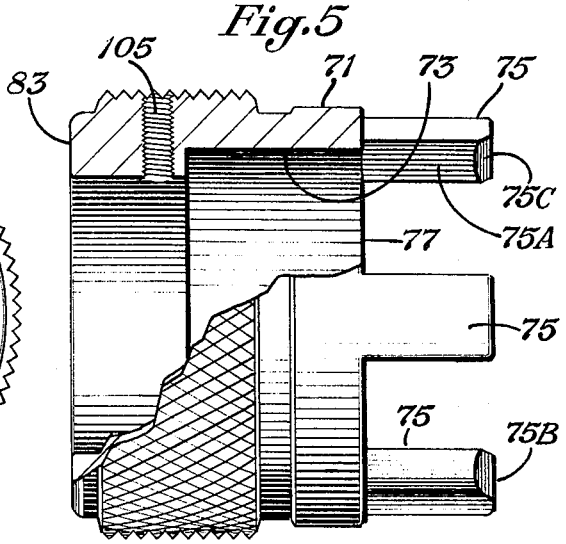
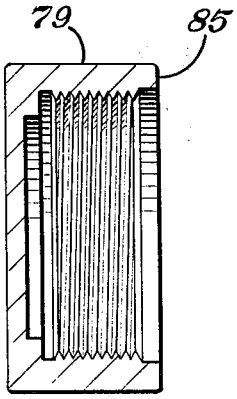
Fig. 6
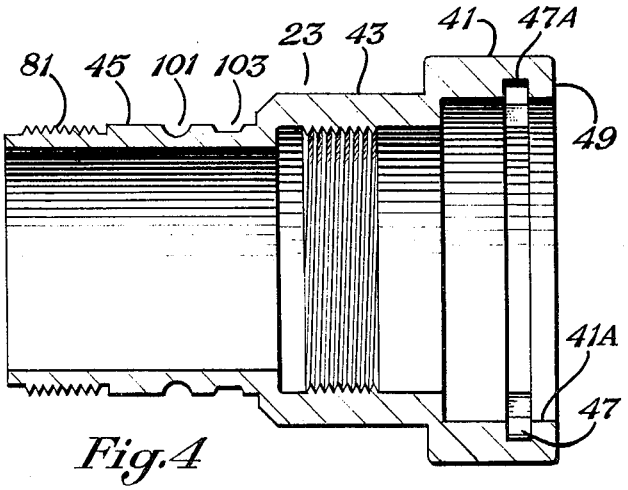
Fig. 4

LATCH

BACKGROUND OF THE INVENTION

1. Field of the Invention

The present invention relates to a latch for latching two members together such as two electrical connecting members.

2. Summary of the Invention

The latch comprises a body having forward end with space surrounded by a wall for receiving, in a latching position, one end of a member having an outer annular groove at said one end. In the latching position said outer annular groove of said member is located within said space at said forward end of said body. An inner annular groove is formed in the inner portion of said wall at said forward end of said body at a position such that said inner annular groove of said body is in the same plane as said outer annular groove of said member when said one end of said member is located within said space at said forward end of said body in said latching position. The outer portion of said wall at said forward end of said body has at least one axially extending groove formed therein which intersects said inner annular groove forming an opening which exposes said inner annular groove through said axially extending groove. An annular coiled spring means is located in said inner annular groove. A sleeve is carried by said body for axial sliding movement between forward and rearward positions. An arm extends from the forward end of said sleeve for sliding movement in said axially extending groove as said sleeve is moved axially between said forward and rearward positions. In said rearward position of said sleeve, said arm allows said annular coiled spring means to extend partially through said opening allowing said one end of said member to be located within said space at said forward end of said body in said latching position. In said forward position of said sleeve, said arm forces the portion of said annular coiled spring at said opening inward into said space at said forward end of said body and into said outer annular groove of said member when said one end of said member is located within said space at said forward end of said body in said latching position to latch said body and said member together.

In a further aspect, the outer portion of said wall at said forward end of said body has at least two angularly spaced apart axially extending grooves formed therein which intersect said inner annular groove forming two angularly spaced apart openings which expose said inner annular groove through said two angularly spaced apart axially extending grooves. At least two angularly spaced apart arms extend from the forward end of said sleeve for sliding movement in said two angularly spaced apart axially extending grooves respectively as said sleeve is moved axially between said forward and rearward positions. In said rearward position of said sleeve, said arms allow said annular coiled spring means to extend partially through said openings allowing said one end of said member to be located within said space at said forward end of said body in said latching position. In said forward position of said sleeve, said arms force the portions of said annular coiled spring at said openings inward into said space at said forward end of said body and into said outer annular groove of said member when said one end of said member is located within said space at said forward end of said body in said latching position to latch said body and said member together.

In the embodiment disclosed, the body of the latch carries an electrical connector and the latch is employed to secure the electrical connector to another electrical connector carried by said member.

BRIEF DESCRIPTION OF THE DRAWINGS

FIG. 4 is a cross-sectional side view of the housing of the latch of FIGS. 1–3.

FIG. 5 is a partial cross-sectional side view of an axially slidable sleeve which is located around the housing of the latch in FIGS. 1–3.

FIG. 6 is a cross-sectional side view of a rear cap to be secured to the housing of FIG. 4 after the sleeve of FIG. 5 is located around the housing.

FIG. 7 is a front view of the latch with the sleeve of FIG. 5 located in a rearward position.

FIG. 8 is a front view of the latch with the sleeve of FIG. 5 located in a forward position.

FIG. 9 is a front view of the member of FIG. 1 to which the latch is to be secured.

DESCRIPTION OF THE PREFERRED EMBODIMENT

Figure 3:
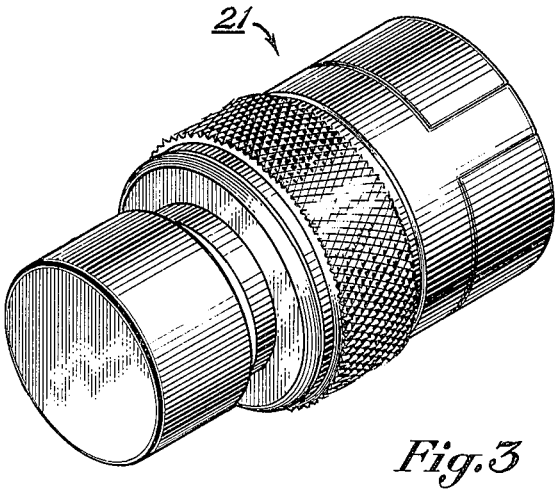
FIG. 3 is a rear perspective view of the latch of the present invention.
Figure 10:
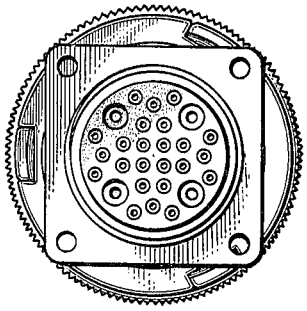
FIG. 10 is a rear view of the member of FIG. 1 to which the latch is to be secured.

Referring now to the drawings the latch of the present invention is identified at 21. It comprises a housing 23 which carries an electrical component (not shown) connected to an electrical connector 25 having a number of male prongs 27 to be inserted into corresponding female sockets 29 of an electrical connector 31 carried by member 33. In one embodiment connector 31 carried by member 33 is an umbilical connector secured to an aircraft and connected to the fuel gauge. The electrical component carried by the housing 23 when connected to the fuel gauge by way of connectors 25 and 31 makes the fuel gauge indicate a full tank of fuel. The purpose of the latch 21 is to secure the two connectors 25 and 31 together after they have been connected together in a mating relationship.

The member 33 comprises an annular shaped housing 35 with an outer annular groove 37 formed around the housing near its forward end 39. The connector 31 is located within the housing 35 with its forward end 31A located rearward of the forward end 39 of the housing 35. Reference numeral 31B in FIGS. 1 and 2 identifies the rear end of the connector 31.

Figure 1:
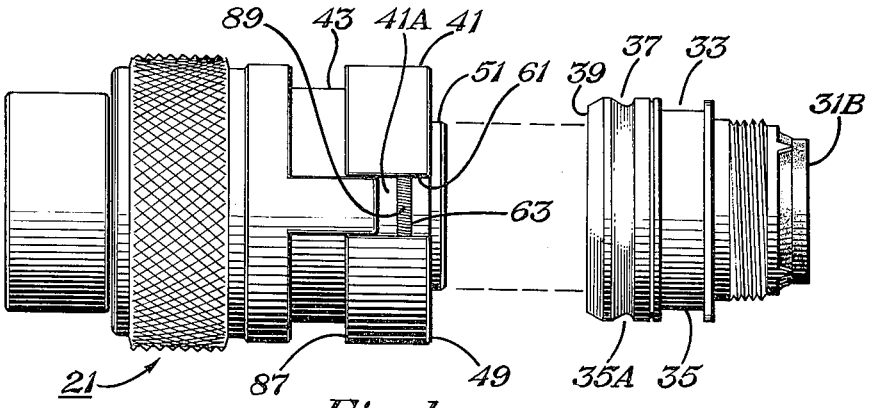
FIG. 1 is a side view of the latch of the present invention and a member to which the latch is to be secured.

The housing 23 of the latch 21 has three cylindrical shaped portions, a forward end portion 41, an intermediate portion 43 and a rear portion 45. An inner annular groove 47 is formed in the inside wall of the cylindrical portion 41 rearward of its forward edge 49. The electrical component is located in portions 43 and 45 with the forward end 25A of the connector 25 extending to about the plane of the inner annular groove 47. A thin cylindrical shield 51 is located around the connector 25 and extends slightly forward of the forward edge 49 as shown in FIG. 1. The shield 51 and the inside wall of the forward cylindrical portion 41 define an annular space 53 for receiving the forward portion 35A of the housing 35 of member 33 to a latching position where the forward ends 25A and 31A of connectors 25 and 31 abut against each other when properly mated and where the outer groove 37 of member 33 is located in the plane of inner groove 47 of housing 23.

Three angular spaced apart grooves 61 are formed in the outer wall of the cylindrical shaped forward end portion 41 of the housing 23 such that they intersect the inner annular groove 47 forming three openings 63 which expose the annular groove 47 through the grooves 61. The grooves 61 extend axially of the housing 23 with the centers of adjacent grooves being located 120° apart.

Figure 2:
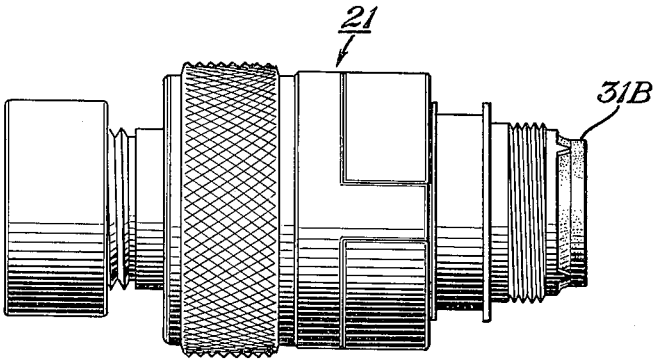
FIG. 2 is a side view of the latch and member of FIG. 1 secured together.

An annular shaped sleeve 71 is located around the housing 23 for axial sliding movement between a rearward position as shown in FIG. 1 and a forward position as shown in FIG. 2. The inside surface 73 of sleeve 71 slides on intermediate portion 43 of the housing 23. The sleeve 71 has three angularly spaced apart arms 75 extending forward of its front end 77 for sliding movement in the three axially extending grooves 61. In the grooves 61, the inner walls 75A of the arms 75 slide on surfaces 41A which are at the same radius as the outer surface of intermediate portion 43 of housing 23. The centers of adjacent arms 75 are 120° apart. After the sleeve 71 has been inserted in place, a cap 79 is screwed to threads 81 formed on the rear portion 45 of the housing 23. In the rearward position of the sleeve 71, its rear end 83 abuts against the front end 85 of cap 79 and the arms 75 are located rearward of the openings 63 exposing the openings 63 through the grooves 61. In the forward position of the sleeve 71, its front edge 77 abuts against the rear edge 87 of cylindrical portion 41 of the housing 23 and its arms 75 are located over the openings 63. The front end portions 75B of the arms 75 are beveled at 75C.

An annular shaped coiled spring 89 is located in the annular groove 47. The outer diameter of the ring formed by the spring 89 is slightly greater than the outer diameter of the annular groove 47 such that the coils of the spring 89 are urged against the outer wall 47A of the groove 47 and through the openings 63 as shown in FIG. 7. The diameter of the coils of the spring 89 are slightly less than the distance between the inner wall 41A of cylindrical shaped member 41 and the outer wall 47A of the annular groove 47 such that when the sleeve 71 is in its rearward position, the forward end 35A of the housing 35 may enter the annular space 53 to the latching position to allow the prongs 27 of connector 25 to be located in the sockets 29 of connector 31 with the front ends 25A and 31A of the connectors 25 and 31 abutting each other and with the outer groove 37 of housing 35 located in the plane of the inner groove 47 of housing 23. In order to latch the two connectors 25 and 31 together the sleeve 71 is slid to the forward position. In this position, the inner walls 75A of the arms 75 force the spring 89 at the openings 63 inward and into the outer groove 37 of the housing 37 latching members 21 and 33 together and preventing the two connectors 25 and 31 from being disconnected. The beveled edges 75C of the front ends of the arms 75 facilitate moving the spring 89 inward as the arms 75 are moved forward. FIG. 7 illustrate the position of the spring 89 at the openings 63 when the sleeve 51 and hence the arms 75 are in the rearward position. FIG. 8 illustrates the position of the spring 89 at the openings 63 when the arms 75 are in the forward position forcing the spring 89 inward of the cylindrical forward portion 41 of the housing 23. When it is desired to unlatch members 21 and 33 and hence the connectors 25 and 31, the sleeve 51 and arms 75 are moved to the rearward position to allow spring 89 to move out of the annular groove 37 whereby the two members 21 and 33 and hence the two connectors 25 and 31 may be disconnected.

Figure 11:
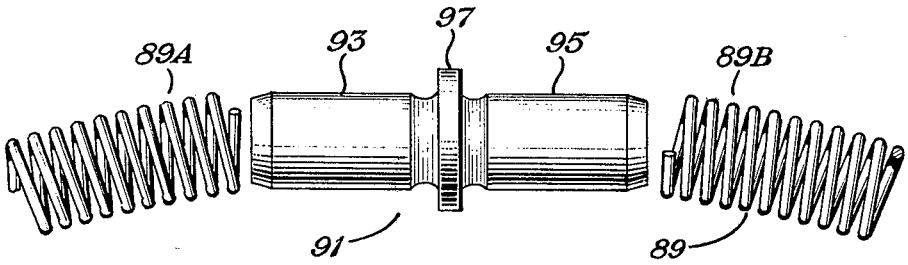
FIG. 11 illustrates a pin employed for securing together the ends of an annular coiled spring employed in the latch of the present invention.
Figure 12:
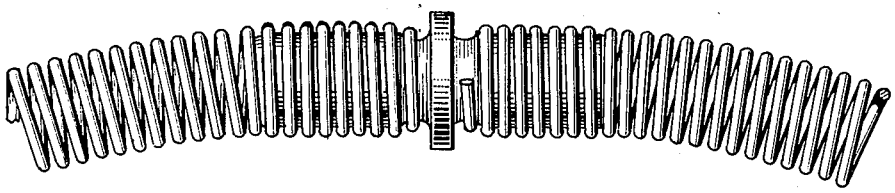
FIG. 12 illustrates the two ends of a coiled spring employed in the latch secured together with the pin of FIG. 11.

Referring to FIGS. 11 and 12, the two opposite ends 89A and 89B of the coiled spring 89 are connected together by a pin 91. The pin 91 has two cylindrical end portions 93 and 95 which tightly fit into the ends 89A and 89B of the spring 89. An enlarged intermediate disc shaped flange 97 of the pin 91 separates the ends of the spring. The end portions 93 and 95 of the pin also may be threaded for allowing the ends 89A and 89B of the spring 89 to be screwed to the pin.

Referring to FIGS. 4 and 5, the rear cylindrical portion 45 of the housing 23 has two annular grooves 101 and 103 for receiving two small angularly spaced apart spring biased balls (not shown) as the sleeve 71 is moved between its rearward and forward positions. Each ball is located in an aperture formed through the sleeve 51. One such aperture is shown at 105 in FIG. 5. The ball and spring is located in the aperture 105 and the outer opening of the aperture is closed with a small nut. The other aperture is angularly spaced from the aperture 105 in the same plane. The purpose of the spring biased balls is to more securely hold the sleeve 71 in its forward or rearward positions but to allow the sleeve 71 to be slid between its forward and rearward positions.

I claim

1. A latch, comprising:

a body having a forward end with space surrounded by a wall for receiving, in a latching position, one end of a member having an outer annular groove at said one end, in said latching position, said outer annular groove of said member being located within said space at said forward end of said body, an inner annular groove formed in the inner portion of said wall at said forward end of said body at a position such that said inner annular groove of said body is in the same plane as said outer annular groove of said member when said one end of said member is located within said space at said forward end of said body in said latching position, the outer portion of said wall at said forward end of said body having at least one axially extending groove formed therein which intersects said inner annular groove forming an opening which exposes said inner annular groove through said axially extending groove, annular coiled spring means located in said inner annular groove, a sleeve carried by said body for axial sliding movement between forward and rearward positions, an arm extending from the forward end of said sleeve for sliding movement in said axially extending groove as said sleeve is moved axially between said forward and rearward positions, in said rearward position of said sleeve, said arm allowing the said annular coiled spring means to extend partially through said opening allowing said one end of said member to be located within said space at said forward end of said body in said latching position, in said forward position of said sleeve, said arm forcing the portion of said annular coiled spring at said opening inward into space at said forward end of said body and into said outer annular groove of said member when said one end of said member is located within said space at said forward end of said body in said latching position to latch said body and said member together.

2. The latch of claim 1, wherein:

said annular coiled spring means comprises a single coiled spring having two ends connected together by a pin means forming an annular coiled spring, said pin means comprising a member having opposite end portions inserted into said two ends respectively of said coiled spring and an intermediate flange larger in cross-section than the cross-sections of said opposite end portions.

3. The latch of claims 1 or 2 wherein:

said wall at said forward end of said body comprises an annular wall.

4. A latch, comprising:

a body having a forward end with space surrounded by a wall for receiving in a latching position one end of a member having an outer annular groove at said one end, in latching position, said outer annular groove of said member being located within said space at said forward end of said body, an inner annular groove formed in the inner portion of said wall at said forward end of said body at a position such that said inner annular groove of said body is in the same plane as said outer annular groove of said member when said one end of said member is located within said space at said forward end of said body in said latching position, the outer portion of said wall at said forward end of said body having at least two angularly spaced apart axially extending grooves formed therein which intersect said inner annular groove forming two angularly spaced apart openings which expose said inner annular groove through said two angularly spaced apart axially extending grooves, annular coiled spring means located in said inner annular groove, a sleeve carried by said body for axial sliding movement between forward and rearward positions, at least two angularly spaced apart arms extending from the forward end of said sleeve for sliding movement in said two angularly spaced apart axially extending grooves respectively as said sleeve is moved axially between said forward and rearward positions, in said rearward position of said sleeve, said arms allowing said annular coiled spring means to extend partially through said openings allowing said one end of said member to be located within said space at said forward end of said body in said latching position, in said forward position of said sleeve, said arms forcing the portions of said annular coiled spring at said openings inward into said space at said forward end of said body and into said outer annular groove of said member when said one end of said member is located within said space at said forward end of said body in said latching position to latch said body and said member together.

5. The latch of claim 4, wherein:

said annular coiled spring means comprises a single coiled spring having two ends connected together by a pin means forming an annular coiled spring, said pin means comprising a member having opposite end portions inserted into said two ends respectively of said coiled spring and an intermediate flange larger in cross-section than the cross-sections of said opposite end portions.

6. The latch of claims 4 or 5, wherein:

said wall at said forward end of said body comprises an annular wall.

7. A latching apparatus for latching two connecting means together in a given relationship, one of said connecting means being carried by a member having an outer annular groove at one end thereof, comprising:

a body carrying the other of said connecting means, said body having a forward end with space surrounded by an annular wall for receiving said one end of said member in a latching position with said outer annular groove located within said space at said forward end, an inner annular groove formed in the inner portion of said annular wall at said forward end of said body at a position such that said inner annular groove of said body is in the same plane as said outer annular groove of said member when said one end of said member is located within said space at said forward end of said body in said latching position, the inner portion of said annular wall at said forward end of said body having at least two angularly spaced apart axially extending grooves formed therein which intersect said inner annular groove forming two angularly spaced apart openings which expose said inner annular groove through said two angularly spaced apart axially extending grooves, annular coiled spring means located in said inner annular groove, a sleeve carried by said body for axial sliding movement between forward and rearward positions, at least two angularly spaced apart arms extending from the forward end of said sleeve for sliding movement in said two angularly spaced apart axially extending grooves respectively as said sleeve is moved axially between said forward and rearward positions, in said rearward position of said sleeve, said arms allowing said annular coiled spring means to extend partially through said openings allowing said one end of said member to be located within said space at said forward end of said body in said latching position with said two connecting means in said given relationship, in said forward position of said sleeve, said arms forcing the portions of said annular coiled spring means at said openings inward into said space at said forward end of said body and into said outer annular groove of said member when said one end of said member is located within said space at said forward end of said body in said latching position to latch said body and said member together and said two connecting means together in said given relationship.

* * * * *